US009474375B2

(12) United States Patent
Robertson

(10) Patent No.: US 9,474,375 B2
(45) Date of Patent: Oct. 25, 2016

(54) ADJUSTABLE FURNITURE

(75) Inventor: Dale Robertson, Cheltenham (GB)

(73) Assignee: INTEGRATED FURNITURE TECHNOLOGIES LIMITED, Gloucestershire (GB)

( * ) Notice: Subject to any disclaimer, the term of this patent is extended or adjusted under 35 U.S.C. 154(b) by 295 days.

(21) Appl. No.: 12/597,080

(22) PCT Filed: Apr. 28, 2008

(86) PCT No.: PCT/GB2008/001504

§ 371 (c)(1),
(2), (4) Date: Feb. 17, 2010

(87) PCT Pub. No.: WO2008/132481

PCT Pub. Date: Nov. 6, 2008

(65) Prior Publication Data

US 2010/0132118 A1 Jun. 3, 2010

(30) Foreign Application Priority Data

Apr. 26, 2007 (GB) ..... 0708053.4
Feb. 20, 2008 (GB) ..... 0803049.6

(51) Int. Cl.
*A47C 1/02* (2006.01)
*A47C 1/024* (2006.01)
*A47C 1/034* (2006.01)

(52) U.S. Cl.
CPC ..... *A47C 1/0242* (2013.01); *A47C 1/0342* (2013.01)

(58) Field of Classification Search
CPC ..... A47C 1/0242; A47C 1/0342
USPC ..... 297/83, 84, 85 M, 87, 320, 322, 342, 297/343
See application file for complete search history.

(56) References Cited

U.S. PATENT DOCUMENTS

| | | | | |
|---|---|---|---|---|
| 349,089 A | | 9/1886 | Gilbert | |
| 638,466 A | | 12/1899 | Kelly | |
| 809,944 A | * | 1/1906 | Hanger | 297/342 |
| 912,214 A | | 2/1909 | Ward | |
| 942,354 A | | 12/1909 | Ryan | |
| 1,238,078 A | | 8/1917 | Ault | |
| 1,414,637 A | | 5/1922 | Gell | |
| 1,802,609 A | * | 4/1931 | Krause | 297/343 |

(Continued)

FOREIGN PATENT DOCUMENTS

| | | |
|---|---|---|
| DE | 29 33 160 | 2/1981 |
| DE | 297 15 343 | 11/1997 |

(Continued)

OTHER PUBLICATIONS

Search Report for GB1017996.8 dated Feb. 24, 2011, 2 pages.

(Continued)

*Primary Examiner* — Anthony D Barfield
(74) *Attorney, Agent, or Firm* — Andrew F. Young, Esq.; Lackenbach Siegel, LLP

(57) ABSTRACT

Described is adjustable furniture comprising a first furniture component (28), a second furniture component (10,12,14) movable, in use relative to the first furniture component (28) and supported by a guide arrangement comprising a guide (24) associated with one of the first and second components and at least one follower (22) associated with the other of the first and second components and movable along the guide (24).

20 Claims, 6 Drawing Sheets

(56) References Cited

U.S. PATENT DOCUMENTS

| | | | | |
|---|---|---|---|---|
| 2,954,072 | A | 9/1960 | Fossati | |
| 3,086,814 | A | 4/1963 | Fletcher | |
| 3,121,589 | A | 2/1964 | Schliephacke | |
| 3,202,453 | A | 8/1965 | Richards | |
| 3,269,767 | A | 8/1966 | Marzocchi | |
| 1,075,154 | A | 7/1967 | Gibbs | |
| 3,363,942 | A * | 1/1968 | Fletcher | 297/322 |
| 3,572,829 | A * | 3/1971 | Malitte | 297/317 |
| 3,869,169 | A * | 3/1975 | Johnson et al. | 297/84 |
| 3,873,152 | A | 3/1975 | Garas | |
| 4,365,836 | A * | 12/1982 | Jackson et al. | 297/85 M |
| 4,547,017 | A | 10/1985 | Lescure | |
| 4,635,999 | A | 1/1987 | Simpson | |
| 5,112,109 | A | 5/1992 | Takada et al. | |
| 5,246,266 | A | 9/1993 | Ostergaard | |
| 5,622,406 | A * | 4/1997 | Meschkat et al. | 297/318 |
| 5,735,574 | A * | 4/1998 | Serber | 297/284.4 |
| 5,785,384 | A | 7/1998 | Sagstuen | |
| 5,897,462 | A | 4/1999 | St. Germain | |
| 5,967,609 | A | 10/1999 | Potter | |
| 6,059,364 | A | 5/2000 | Dryburgh et al. | |
| 6,203,106 | B1 * | 3/2001 | Nearing et al. | 297/329 |
| 6,227,489 | B1 * | 5/2001 | Kitamoto et al. | 244/118.5 |
| 6,494,536 | B2 * | 12/2002 | Plant | 297/284.11 |
| 6,568,755 | B1 | 5/2003 | Groening | |
| 6,641,214 | B2 * | 11/2003 | Veneruso | 297/322 |
| 6,739,661 | B1 | 5/2004 | Dukes | |
| 7,219,958 | B2 | 5/2007 | Yamazaki et al. | |
| 7,390,060 | B2 | 6/2008 | Kristen | |
| 7,445,279 | B2 | 11/2008 | Crum | |
| 7,698,761 | B2 | 4/2010 | Neuenswander et al. | |
| 7,703,851 | B2 | 4/2010 | Nakaya et al. | |
| 7,997,654 | B2 | 8/2011 | Ferry et al. | |
| 8,303,036 | B2 | 11/2012 | Hankinson et al. | |
| 8,403,415 | B2 | 3/2013 | Lawson | |
| 8,424,964 | B2 | 4/2013 | Campbell et al. | |
| 8,534,758 | B2 | 9/2013 | Rivera | |
| 2002/0053109 | A1 | 5/2002 | Elliott | |
| 2002/0060483 | A1 | 5/2002 | Yoshida et al. | |
| 2002/0174487 | A1 | 11/2002 | Kramer et al. | |
| 2003/0080597 | A1 * | 5/2003 | Beroth et al. | 297/330 |
| 2003/0172455 | A1 | 9/2003 | Roma et al. | |
| 2004/0155504 | A1 | 8/2004 | Tada | |
| 2007/0120409 | A1 | 5/2007 | Leeds | |
| 2007/0158980 | A1 | 7/2007 | LaPointe et al. | |
| 2008/0150329 | A1 | 6/2008 | Lawson | |

FOREIGN PATENT DOCUMENTS

| | | |
|---|---|---|
| DE | 029715343 | 1/1998 |
| DE | 298 08 584 | 10/1998 |
| DE | 010152227 | 5/2003 |
| DE | 10 2007 024 218 | 11/2008 |
| DE | 10 2007 02421 | 11/2008 |
| DE | 102007024218 | 11/2008 |
| EP | 0781518 | 12/1996 |
| EP | 0801913 | 10/1997 |
| EP | 0865960 | 3/1998 |
| EP | 0865960 | 9/1998 |
| EP | 0 891 730 | 1/1999 |
| EP | 1 621 173 | 2/2006 |
| EP | 1 908 374 | 4/2008 |
| GB | 0101239 | 8/1916 |
| GB | 0329834 | 5/1930 |
| GB | 0414464 | 8/1934 |
| GB | 0775679 | 5/1957 |
| GB | 2227932 | 8/1990 |
| GB | 2 266 838 | 11/1993 |
| GB | 013 2 266 838 | 11/1993 |
| GB | 2271053 | 4/1994 |
| GB | 2 436 474 | 9/2007 |
| GB | 013 2 436 474 | 9/2007 |
| GB | 2 450 199 | 12/2008 |
| GB | 2474947 | 10/2010 |
| GB | 2486335 | 6/2012 |
| GB | 2486599 | 6/2012 |
| GB | 2496597 | 6/2012 |
| GB | 2472920 | 2/2014 |
| GB | 2501993 | 4/2014 |
| GB | 191322022 | 8/2014 |
| JP | 36-13946 | 5/1936 |
| JP | 61 181562 | 11/1986 |
| JP | 01214308 | 8/1989 |
| JP | 08-173263 | 7/1996 |
| JP | 08-308680 | 11/1996 |
| JP | 11-244096 | 9/1999 |
| JP | 2003-144262 | 5/2003 |
| JP | 2003310666 | 11/2003 |
| JP | 2008149858 | 7/2008 |
| NL | 9400473 | 11/1995 |
| WO | WO 2004/107916 | 12/2004 |
| WO | WO 2006/023447 | 3/2006 |
| WO | WO 2007/014564 | 2/2007 |
| WO | WO 2008/132481 | 11/2008 |
| WO | WO/2011/021002 | 2/2011 |
| WO | WO 2011/048384 | 4/2011 |

OTHER PUBLICATIONS

Search Report for GB0807669.7 dated Jul. 3, 2008, 2 pages.
Office Action for GB0807669.7 dated Apr. 10, 2012, 4 pages.
Search Report for GB1202452.7 dated Apr. 10, 2012, 2 pages.
Search Report for GB1202643.1 dated Apr. 11, 2012, 2 pages.
International Search Report for PCT/GB2010/001565 dated May 26, 2011, 6 pages.
Combined Search and Examination report for GB 1013879.0, dated Dec. 7, 2010 (6 pages).
International Search Report for PCT/GB2010/001961 dated Nov. 2, 2011, 2 pages.
International Search Report and Written Opinion for PCT/GB2008/001504 dated Sep. 24, 2008, 13 Pages.
U.S. Appl. No. 13/380,985, filed Feb. 2012, Robertson.
Appln. Serial No. GB0807669.7 Office Action dated Apr. 10, 2012, 4 pages—English.
PCT/GB2010/001565 International Seareh Report mailed Apr. 12, 2011, 6 pages—English.
PCT/GB2008/001504 International Search Report mailed May 12, 2008, 5 pages—English.
U.S. Appl. No. 13/390,985, filed Feb. 17, 2012, Office Action mailed Jan. 7, 2015, 20 pages.

* cited by examiner

ADJUSTABLE FURNITURE

CROSS REFERENCE TO RELATED APPLICATIONS

This application is related to, and claims priority from, Great Britain Patent Application No. 0708053.4 filed Apr. 26, 2007 and Great Britain Patent Application No. 0803049.6 filed Feb. 20, 2008. This application is also related to and claims priority from Patent Cooperation Treaty (PCT) Application No. PCT/GB2008/001504 filed Apr. 28, 2008, and published Jun. 11, 2008 with International Publication No. WO/2008/132481, the entire contents of which are herein incorporated fully by reference.

FIELD OF THE INVENTION

This invention relates to adjustable furniture, for example to chairs or beds or the like in which the position of one weight or load carrying part of the furniture can be moved relative to another. The adjustment may be motorised or alternatively may be achieved manually.

BACKGROUND OF THE INVENTION

Adjustable chairs are well known in which the angle of the seat back can be changed in order to provide a recline position and/or in which a movable foot rest is provided. Chairs of this type are available in which adjustment is achieved manually or in a motorised fashion. Some motorised chairs have the ability to incline the seat of the chair to assist the user in moving from a seated position to a standing position. Adjustable beds are also known in which a head and upper back supporting region of the bed can be moved to adjust the inclination thereof.

Typically, the movable parts of such items of furniture are supported upon relatively complex, typically steel, support arrangements, often including a series of linkages movable to allow the movable part of the piece of furniture to travel through its desired range of movement. Such support arrangements are often costly and heavy, making transportation, handling and use awkward, and place severe restrictions on the designs of furniture which are available.

SUMMARY OF THE INVENTION

It is an object of the invention to provide an arrangement in which the disadvantages set out above are reduced.

According to the present invention there is provided adjustable furniture comprising a first furniture component, a second furniture component movable, in use, relative to the first furniture component and supported by a guide arrangement comprising a guide associated with one of the first and second components and at least one follower associated with the other of the first and second components and movable along the guide.

Preferably at least two followers are provided, the followers being in a fixed relationship to one another. The guide conveniently comprises an elongate slot or groove in which the follower(s) are located. The follower(s) conveniently comprise rollers. The guide could, alternatively, comprise a guide rail or the like secured to the said one of the first and second components.

The guide, for example in the form of an elongate slot, or groove, may be of arcuate form, having a fixed radius of curvature, to guide the first and second components for relative pivoting-like movement about a pivot axis located at the centre of curvature of the guide. Alternatively, the guide may be of, for example, part elliptical form or be of a more complex shape.

Where the furniture is a chair, the first and second components may comprise one or more of the base of the chair, the seat pad, the seat back, the foot rest or other supporting part of the chair. Where the furniture is a bed, the components may comprise parts thereof which are relatively movable and which, in use, are adapted to bear at least part of the weight of the user of the furniture.

According to another aspect of the invention there is provided an article of furniture comprising an outer support, and inner support guided for movement relative to the outer support, and back support guided for movement relative to both the inner support and the outer support.

The inner, outer and back supports may be guided for movement using any of the arrangements described hereinbefore.

In such an arrangement, the inner support may comprise, for example, a seat pad support. The arrangement is such that the seat pad support and back support move simultaneously between an upright configuration and a reclined configuration. In the reclined configuration, the back support does not project significantly further rearward of the furniture than when in its upright configuration. The furniture is thus of "zero-wall" form.

The furniture may be manually driven between its upright and reclined configurations, or alternatively may be motorised.

A footrest, for example of the type described hereinbefore may be provided, the footrest being movably mounted to the inner support. It may be manually movable or alternatively may be motorised. Preferably a single motor is used to drive the furniture between its upright and reclined configurations and to drive the footrest. For example, from an upright configuration, an initial part of the motor operation may drive the footrest, a final part of the operation driving the furniture to its reclined configuration.

BRIEF DESCRIPTION OF THE DRAWINGS

The invention will further be described, by way of example, with reference to the accompanying drawings, in which.

DETAILED DESCRIPTION OF THE PREFERRED EMBODIMENTS

Figure 1:
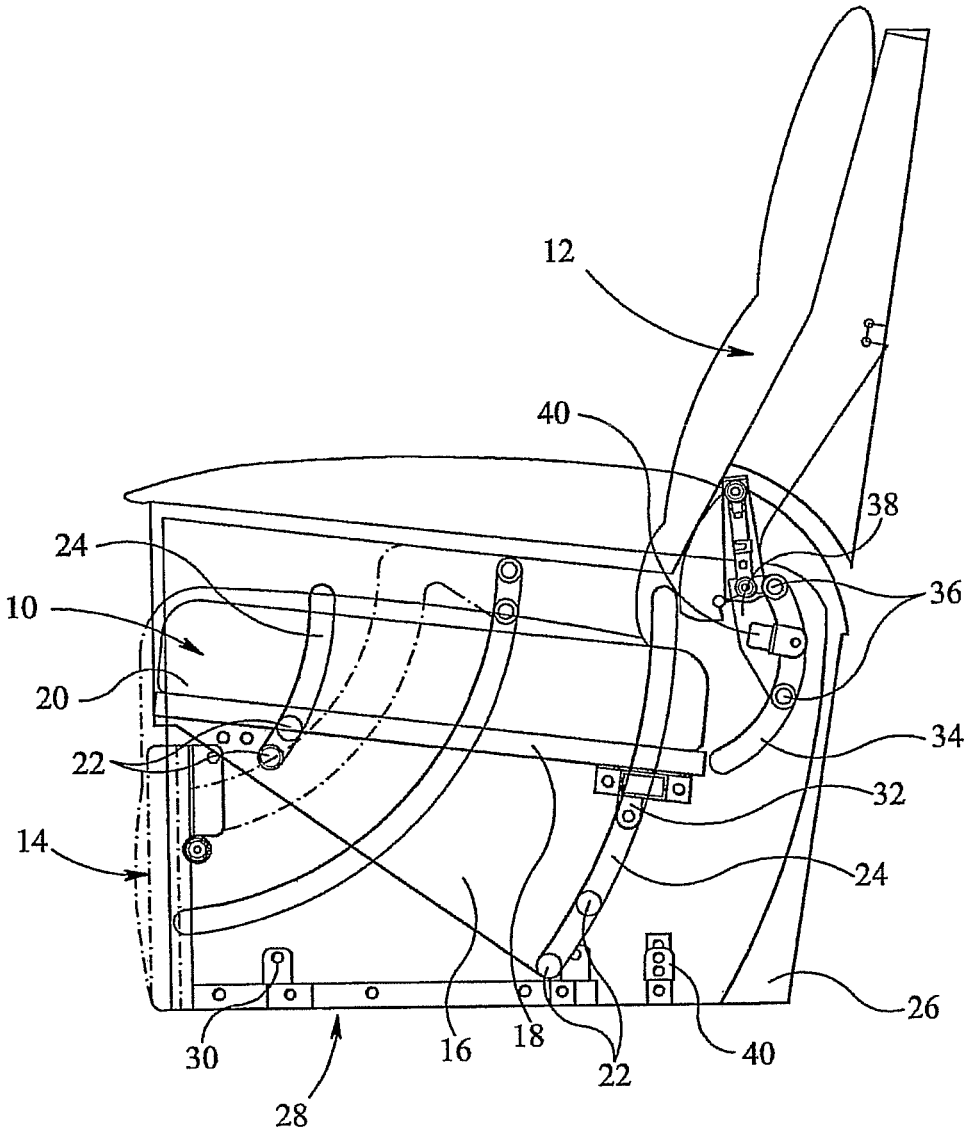
FIG. 1 illustrates an adjustable chair in accordance with one embodiment of the invention.
Figure 2:
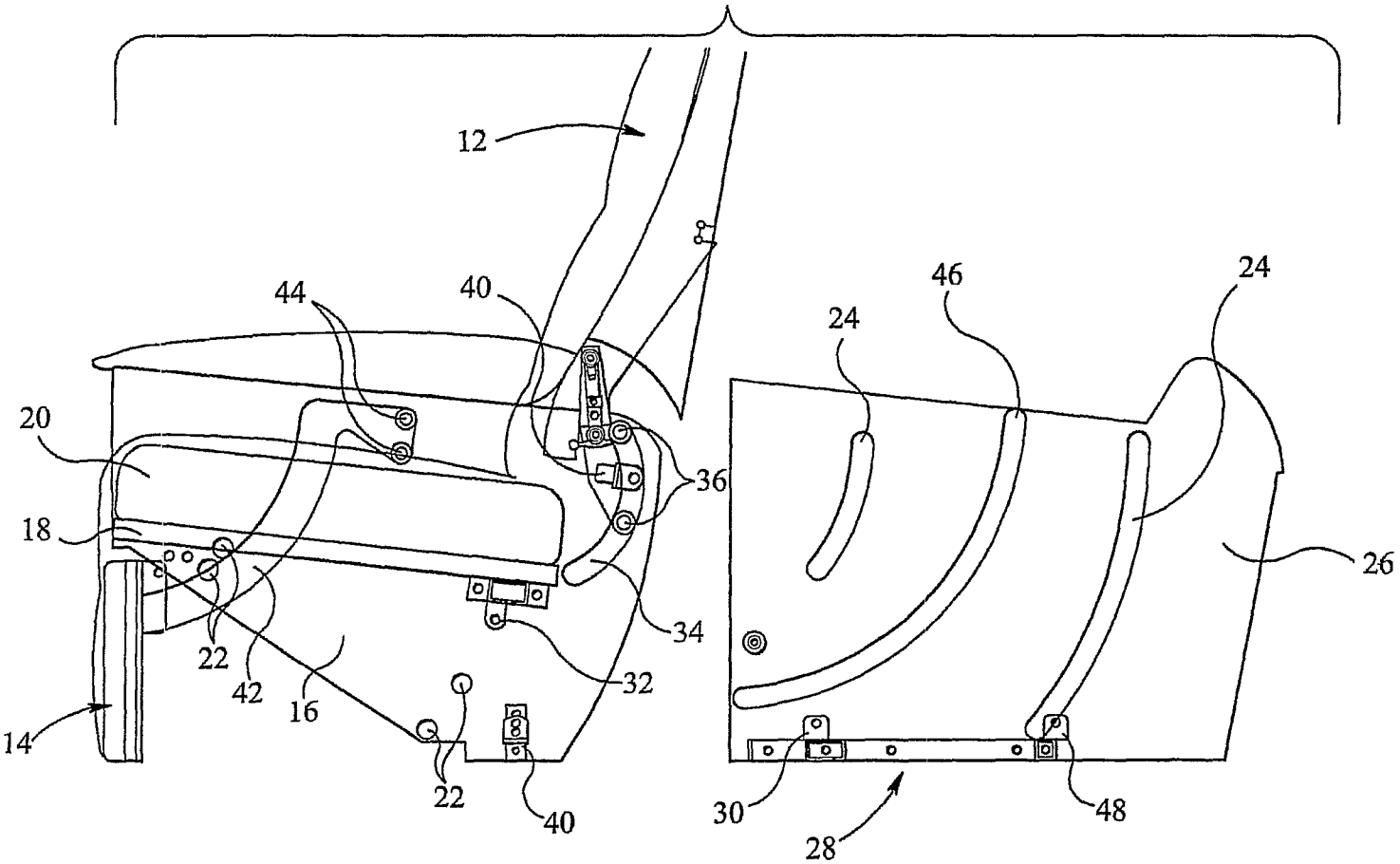
FIG. 2 illustrates some of the components of the chair of FIG. 1.

The chair illustrated in FIGS. 1 and 2 is an adjustable chair of the motorised form and comprises a number of relatively movable chair components. Specifically, the chair comprises a seat pad component 10 which is angularly movable between a position in which it lies generally horizontally (as shown), and a tilted or inclined position in which it is raised to assist a user in moving from a seated position to a standing position. The chair further comprises an adjustable back rest component 12 and an adjustable foot rest component 14.

In the arrangement illustrated in FIG. 1, the seat pad 10 comprises a pair of side support members 16 between which is secured a seat pad support member 18, the upper surface of which carries a suitably padded and upholstered cushion 20. The support members 16 each carry two pairs of rollers 22 which, in use, are able to ride within arcuate guide grooves 24 provided in side members 26 of a base component 28.

The base component 28 and seat pad 10 include respective motor mounting brackets 30, 32 between which a suitable actuator (not shown) is connected. It will be appreciated that if the actuator connected between the brackets 30, 32 is operated to move from a retracted condition in which the seat pad 10 occupies substantially the position illustrated to an extended condition, then the seat pad 10 will be moved, the rollers 22 acting as followers, being guided for movement within the respective arcuate grooves 24 to cause the seat pad 10 to move from the generally horizontal position illustrated to an inclined position, the seat pad 10 moving through a pivot-like motion about a pivot point defined by the centre of curvature of the two arcuate grooves 24.

As illustrated, the side members 16 are each provided with an arcuate groove 34 within which a pair of rollers 36 carried by a bracket 38 can move, the bracket 38 serving to support the seat back 12. It will be appreciated, therefore, that the seat back 12 is guided for pivot-like movement relative to the seat pad 10 about a pivot point located at the centre of curvature of the arcuate groove 34. The bracket 38 and side members 16 are provided with mounting brackets 40 between which an actuator is connected and, as with the seat pad 10, adjustment of the length of the actuator causes the rollers 36 to move within the arcuate groove 34 to adjust the angle of inclination of the seat back 12.

The foot rest 14 is mounted upon a bracket 42 having a pair of rollers 44 secured thereto, the rollers 44 being located within an arcuate groove 46 formed in the side member 26 of the base component 28. The bracket 42 further serves as a mounting bracket for a motor device, the other end of which is secured to a mounting bracket 48 associated with the base component 28 to drive the foot rest 42 between a substantially vertical orientation as illustrated in FIGS. 1 and 2 and a substantially horizontal configuration.

It will be appreciated that from the position illustrated in FIG. 1, if desired a user can operate the motors of the chair to cause the foot rest 14 to be driven from the position illustrated towards a substantially horizontal configuration, the rollers 44 riding within the guide groove 46 to support and guide the foot rest 14 through such movement. The back rest can be adjusted between the substantially vertical position illustrated and a reclined position by operation of the appropriate motor to cause the rollers 36 to ride along the length of the arcuate groove 34, the rollers 36 and groove 34 serving to guide and support the back rest 12 through such movement. The movement of the foot rest 14 may be controlled independently of the movement of the back rest 12, if desired.

Further, from the position illustrated in FIG. 1 the seat pad 10 may be moved to an inclined position, the rollers 22 moving within the arcuate grooves 24 to guide and support the seat pad 10 through such movement, the movement of the seat pad 10 serving to assist a user in moving from a seated position towards a standing position. During the movement of the seat pad, if desired, the position of the seat back 12 relative to the seat pad 10 may also be adjusted so as to ensure that the position of the seat back 12 does not interfere with the movement of the user towards a standing position.

It will be appreciated that as the paths of movement of the various components of the chair are determined by the shape and position of the grooves 24, 34, 46, the chair can be of improved comfort to the user. For example, it is desirable for the seat pad 10 to follow a pivot-like course of movement about a pivot point located at the position of the user's knees. As the user's knees project, in use, in front of the chair, such design is not usually possible. However, with the furniture of the present invention, the shapes and positions of the grooves 24 can be selected so as to achieve such movement. Likewise, the position of the point about which the foot rest 14 pivots can be chosen at will. Similarly, the position of the affective pivotal connection of the back rest 12 to the seat pad 10 can be selected at will so as to be located at approximately the position of the user's hips.

The design is advantageous in that the provision of a complex, typically metallic, support structure for the various moving components of the chair can be avoided. The weight and cost of the furniture can thus be reduced which has obvious benefits. Although in the arrangement described hereinbefore the various components are arranged to undertake relative pivot-like movement, it will be appreciated that by appropriate selection of the shapes and positions of the grooves 24, 34, 46, the paths of movement followed by the various components can take other forms. For example, the grooves could be of part-elliptical form or of a more complex shape. Further, although the use of slots or grooves as the guide means and rollers as the follower means are illustrated, other arrangements are possible. For example, the guide means could take the form of guide rails instead of slots or grooves, if desired.

Figure 3:
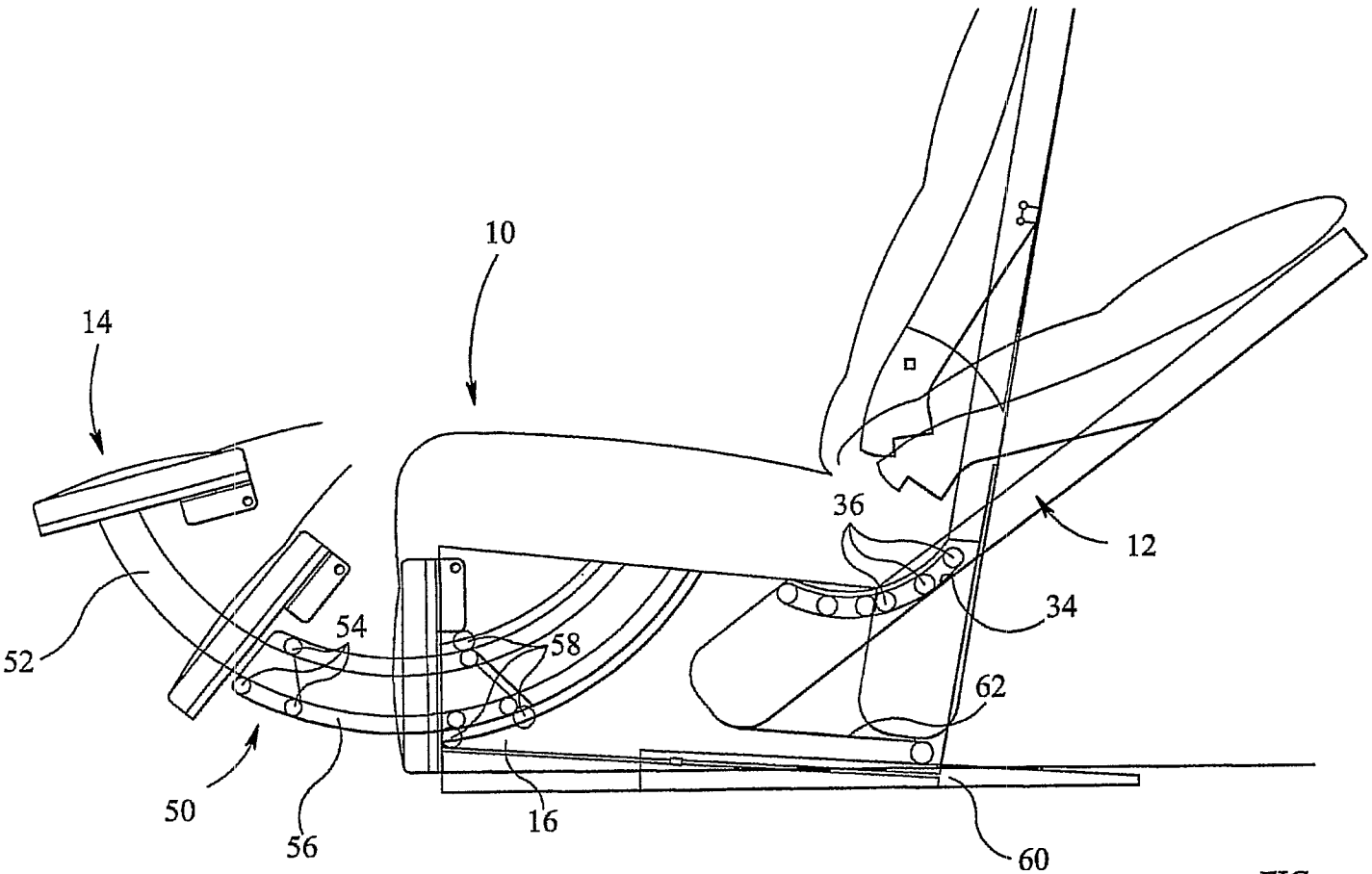
FIGS. 3 and 4 illustrate alternative designs of chair.

FIG. 3 illustrates an alternative design of chair. In the design illustrated in FIG. 3, the seat pad 10 is not designed to move from a generally horizontal position to an inclined position, but rather is intended to remain in its substantially horizontal configuration in normal use. The back rest 12 is secured to the seat pad 10 by an arrangement similar to that illustrated in FIG. 1 but in which three rollers 36 are secured to the back rest 12, the three rollers 36 being movable within the arcuate groove or slot 34.

The foot rest 14 is supported by a telescopic guide arrangement 50. The telescopic guide arrangement 50 comprises an arcuate follower member 52 secured to the foot rest 14 and supported for sliding movement by guide means in the form of three rollers 54. The guide means 54, in turn, are supported upon an arcute auxiliary follower member 56 which, in turn, is supported upon guide means in the form of a further set of three roller members 58 carried by the side members 16. The provision of a telescopic guide arrangement 50 is advantageous in that the entire guide arrangement associated with the foot rest 14 can be housed beneath the seat pad 10. In the arrangement illustrated in FIG. 1, it will be appreciated that part of the guide arrangement for the foot rest 14 extends above the height of the seat pad 10 and is housed within part of the base component 28 which may result in an increase in the dimensions and complexity of the base component.

The arrangement illustrated in FIG. 3 is designed such that when the seat back 12 is moved from its upright configuration to a reclined configuration, the remainder of the chair is moved forwards. Consequently, the furniture can be positioned adjacent a wall and movement of the seat back 12 to a reclined position does not result in the seat back 12 contacting the wall surface as the remainder of the chair moves forward to accommodate such movement. In the arrangement illustrated in FIG. 3, this is achieved by supporting the chair upon a base component 60 by supporting the chair upon rollers, and by using a belt 62 secured to the base component 60, wrapped around one of the rollers and secured to a lower end of the seat back 12 to drive the chair for movement relative to the base component 60, movement of the seat back 12 to its reclined position driving the chair forwardly relative to the base 60.

Figure 4:
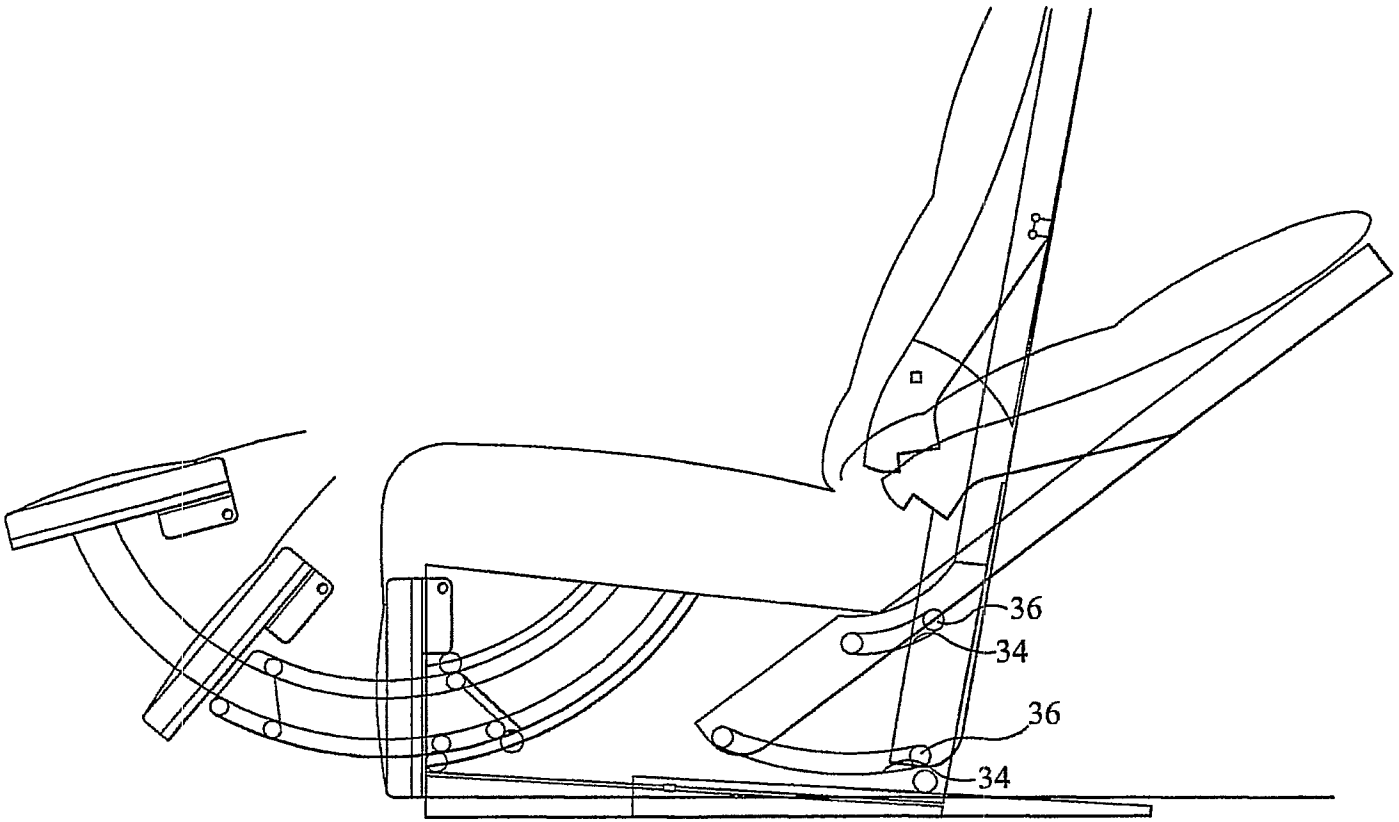

FIG. 4 illustrates another design of chair which is very similar to that of FIG. 3. In the arrangement illustrated in FIG. 4, the seat back 12 is supported by a pair of grooves 34, each of which accommodates a single roller 36. The grooves 34 are concentric about a pivot axis about which the seat back 12 moves, in use.

Figure 5:
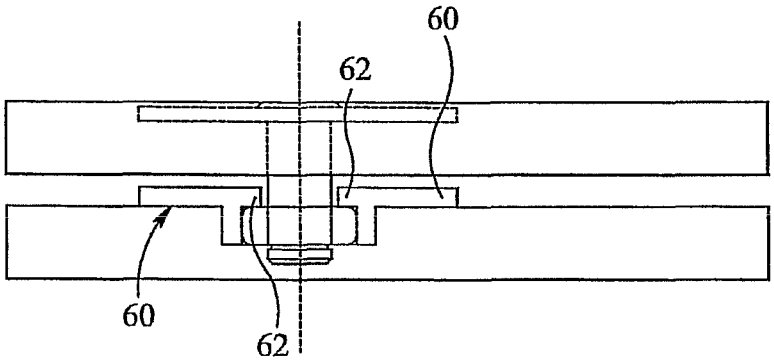
FIG. 5 illustrates, diagrammatically, part of an arrangement suitable for use in the chairs of FIGS. 1 to 4.

Although in the arrangements described hereinbefore the rollers 22, 36 are located directly within associated grooves, liners 60 may be provided (as shown in FIG. 5) to assist in the smooth movement of the rollers 22, 36. The use of liners 60 may increase the range of materials suitable for use in the invention. The liners 60 conveniently include shoulders 62 serving to retain the associated rollers within the grooves. It may, further, be possible to avoid using rollers and instead provide slides slidable within the lined grooves.

Figure 6:
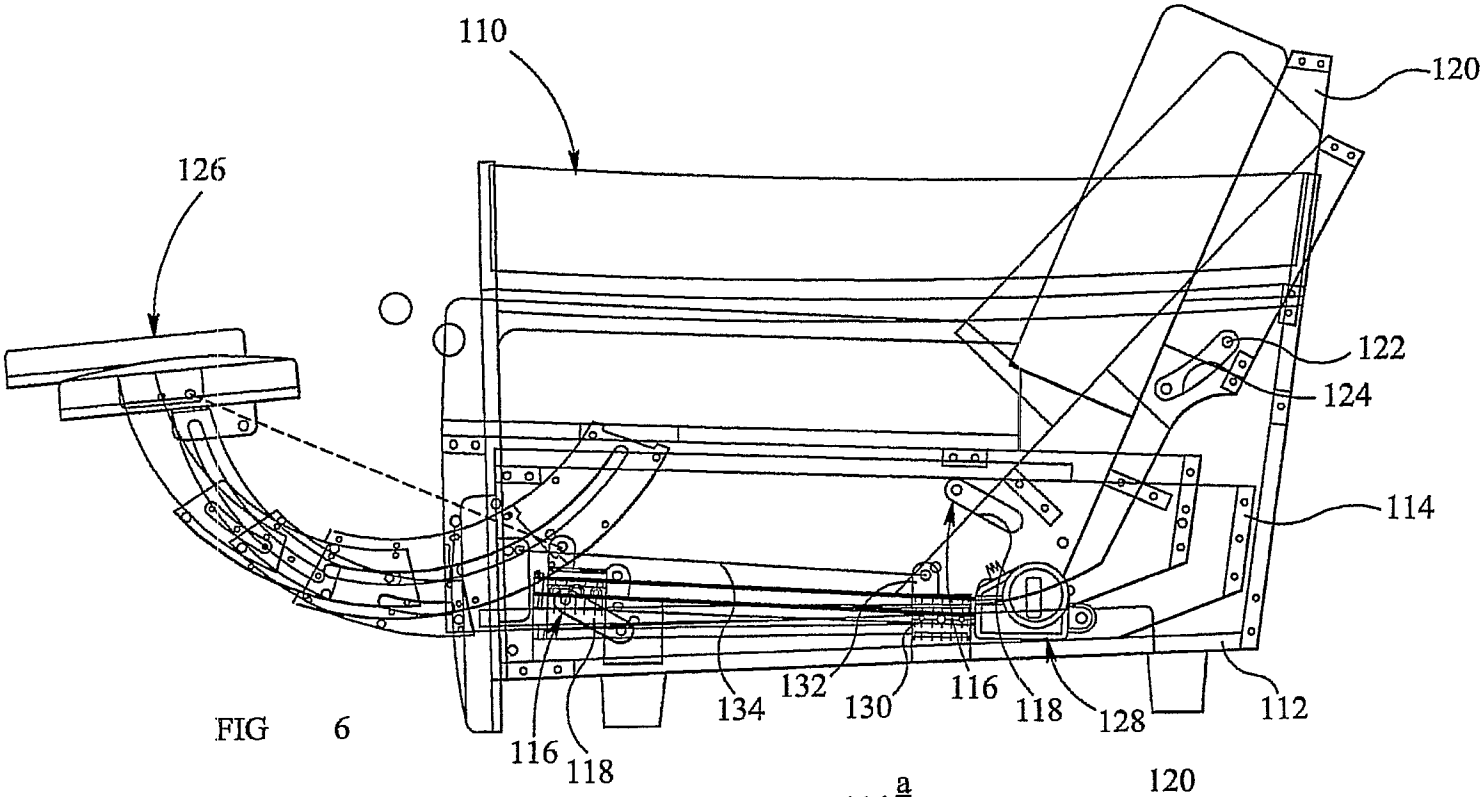
FIG. 6 is a diagrammatic view of a piece of furniture in accordance with one embodiment of the invention.

Referring to FIG. 6 there is illustrated an article of furniture in the form of an armchair 110. Although the article of furniture in this case is an armchair 110, it will be appreciated that the invention described herein is equally applicable to other forms of furniture, for example to sofas or to beds. The chair 110 comprises an outer frame or support 112 including a pair of side walls. An inner frame or support 114 is secured within the outer support 112 for movement relative thereto. The mounting of the inner support 114 to the outer support 112 is in the form of rollers 116 carried by the inner support 114 which are received within guide grooves 118 formed in the outer support 112. It will be appreciated that the inner support 114 is able to move relative to the outer support 112 along a path of movement defined by the shapes and relative orientations of the grooves 118 and, in the arrangement illustrated, the path of movement is an angled translatory movement, the inner support 114 being movable upwards and forwards from one position to another.

The inner support 114 carries the seat pad of the chair 110.

Figure 7:
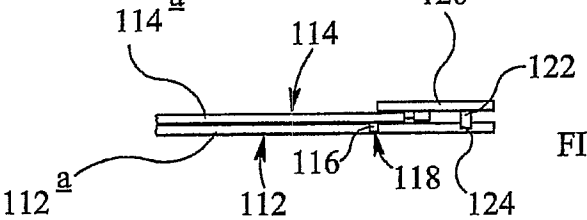
FIG. 7 is a diagrammatic view illustrating one side of the piece of furniture.

The inner and outer supports 112, 114 could take a range of forms but, as best shown in FIG. 7, preferably each include a pair of side walls 112*a*, 114*a*, which lie parallel and adjacent one another.

The chair 110 further comprises a back support 120 which is mounted for movement between an upright position and a reclined position. The back support 120 is provided with a series of rollers located within a guide groove formed in the inner support 114 in the manner described hereinbefore, to guide the back support 120 for reclining movement relative to the inner support 114. The back support 120 is further provided with similar rollers 122 received within grooves or slots 124 formed in the outer support 112, and it will be appreciated that the angle of the back support 120 is dependent upon the position of the inner support 114 relative to the outer support 112 at any given time.

Connected to the inner support 114 is a foot rest assembly 126 of form substantially identical to that described hereinbefore, but including an additional telescopic component and four support bearings, the foot rest assembly 26 being movable between a substantially vertical, rest configuration and a substantially horizontal, in use configuration.

The chair 110 further comprises a motor 128 of the form including a threaded shaft rotatable by the motor, rotation of the shaft causing a nut component to translate along the length of the shaft. The nut component is secured to an output component 130 having a bracket 132 formed thereon to which a drive bar 134 is secured, the drive bar 134 being secured at its opposite end to the foot rest assembly 126. In use, operation of the motor 128 drives the foot rest 126 between its rest and in use configurations.

As illustrated in FIG. 6, the inner support 114 includes an abutment with which the component 130 is engageable at the time at which the foot rest 126 reaches its in use configuration. Once the component 130 has moved into engagement with the abutment, further operation of the motor 128 results in the abutment, and hence the inner support 114 being driven from its rearward position to its forward, raised position. As described hereinbefore, such movement of the inner support 114 results in the back support 120 being driven from its upright condition to its reclined condition. Further, as the foot rest 126 is secured to the inner support 114, it will be appreciated that the movement of the inner support 114 results in similar translatory movement of the foot rest 126. It will thus be appreciated that a single motor 128 can be used to drive both the foot rest 126 between its rest and in use conditions, and to drive the chair 110 between its upright and reclined configurations.

In order to return the chair 110 to its upright configuration, the motor 128 is driven in the reverse direction. The weight of the inner support 114 (and the user if seated upon the chair) results in the inner support 114 translating along the angled path defined by the grooves 18 towards its rearward position which, in turn, results in the back support 120 returning to its upright position. Once the inner support 114 has reached its rearward position, further operation of the motor 128 serves to retract the foot rest 126.

It will be appreciated that the chair 110 has a number of advantages. Firstly, a single motor can be used to drive the foot rest 126 and drive the chair 110 between its upright and reclined configurations. Secondly, it will be appreciated that the chair when in its reclined position does not project significantly further rearward than when in its upright condition. Consequently, the chair 110 is of substantially zero wall form. Further, as the foot rest 126 is deployed prior to commencement of reclining movement of the chair 110, it will be appreciated that the foot rest 126 can be used both with the chair in its upright configuration and with the chair in its reclined configuration.

A number of modifications and alterations may be made to the chair as described hereinbefore. For example, if desired, the chair cold be of manually driven form rather than using a motor. In such an arrangement, upon a lock arrangement being released, a user applying rearward pressure to the back support 120 will drive the back support 120 towards its reclined configuration which, in turn, will drive the inner support 114 from its stowed position to its deployed position. Subsequent release of the lock arrangement in combination with the weight of the inner support 114 will result in the chair 110 being returned to its upright configuration if a lesser force is applied to the back support 120.

In such a manual configuration, the foot rest 126 is conveniently provided with a resilient biassing means, for example a as strut, operable to drive the foot rest 126 towards its horizontal configuration, a load applied to the foot rest 126 by a user returning the foot rest 126 to its substantially vertical configuration.

Where the chair is a so-called wing over arm chair, then the chair may be designed such that, in use, the inner support 112 remains stationary in use, the outer support 114 moving as the chair reclines so that the arm of the chair also moves.

Although the description hereinbefore is of adjustable furniture in the form of adjustable chairs, it will be appreciated that the invention is applicable to other forms of adjustable furniture in which load bearing or weight bearing components thereof are adjustable relative to one another. Further, although the chair designs illustrated in FIGS. 3 and 4 are intended to be manually adjustable or manually driven between their various configurations, it will be appreciated that if desired, the chairs could be automated, appropriate motors being provided to drive the various components of the chairs between the various positions. A number of other modifications and alterations may be made to the arrangements described hereinbefore without departing from the cope of the invention.

The invention claimed is:

1. An article of adjustable furniture, said article comprising:

a first furniture component, a second furniture component movable, in use, relative to the first component and supported by a first telescopic guide arrangement comprising at least one first guide associated with one of said first component and said second component, and at least one first follower associated with the other one of said first component and said second component, said at least one first follower being movable along said at least one first guide, and a third furniture component movable, in use, relative to the first component and supported by a second guide arrangement comprising a second guide associated with one of said first component and said third component, and a second follower associated with the other one of said first component and said third component, said second follower being movable along said second guide;

wherein said first and second guides are of arcuate form;

wherein said first guide is operative to guide said first and third components for relative pivoting like movement about a pivot axis located at a centre of curvature of said first guide;

wherein said pivot axis is located a distance away from and not contained within said first, second, or third components of said article of furniture, wherein said first component comprises a load bearing structural support frame including: a pair of load bearing side panels, one said load bearing side panel on each side of said article of furniture, with each said side panel supporting one of said at least one first guide or said at least one first follower, and actuator means disposed between said side panels, in an interior region of said article of furniture, for relative movement of said second and third components; and wherein said side panels extend downwardly substantially to a floor standing part of said article of furniture to provide lateral shielding of said interior region of said article of furniture between said side panels.

2. The article of adjustable furniture as claimed in claim 1, wherein at least two first guides and at least two first followers are provided that are each associated with one of said first or said second component, each of said first followers being in a fixed relationship with one another.

3. The article of adjustable furniture as claimed in claim 2, wherein each of said first guides comprises a slot or groove in which each of said first followers is located.

4. The article of adjustable furniture as claimed in claim 1, wherein at least one of said first or second follower comprises rollers.

5. The article of adjustable furniture as claimed in claim 1, wherein at least one of said first or second guide comprises a slot or groove in a respective one of said side panel and at least one said first follower is provided on said second component.

6. The article of adjustable furniture as claimed in claim 1, wherein said article of furniture is a chair, said second and third components comprise one or more of a base of said article of furniture, a seat pad of said article of furniture, a seat back of said article of furniture, a foot rest of said article of furniture or other supporting part of said article of furniture.

7. The article of adjustable furniture as claimed in claim 1, wherein said second and third components comprise parts thereof which are relatively movable and which, in use, are adapted to bear at least part of a weight of a user positioned on said furniture.

8. The article of adjustable furniture as claimed in claim 1, wherein said second and third components comprise one or more of a seat, an adjustable backrest or other part(s) thereof which are relatively movable and which, in use, are adapted to bear at least part of a weight of a user of said furniture.

9. An article of adjustable furniture, said article comprising:

a first furniture component, a second furniture component movable relative to said first component and supported by a telescopic guide arrangement comprising a first guide associated with one of said first component and said second component, and at least one first follower associated with the other one of said first component or said second component, said follower being movable along said guide, and a third furniture component movable relative to the first component and supported by a second guide arrangement comprising a second guide associated with one of said first component and said third component, and at least one second follower associated with the other one of said first component and said third component, said at least one second follower being movable along said second guide;

wherein said first and second guides are of arcuate form;

wherein said first guide is operative to guide said third component for relative pivoting like movement about a pivot axis located at a centre of curvature of said first guide;

wherein said pivot axis is located a distance away from and not contained within said first, second, or third components of said article of furniture, wherein said first component comprises a load bearing structural support frame including: a pair of load bearing side panels, one said load bearing side panel on each side of said article of furniture, with each said side panel supporting one of said first guide or said at least one first follower, and actuator means disposed between said side panels in an interior region of said article of furniture for relative movement of said second and third components; and wherein said second and third components comprise parts thereof which are relatively movable and which are adapted to bear at least part of a weight of a user positioned on said article of furniture.

10. The article of adjustable furniture according to claim 9, wherein at least two first guides and at least two first followers are provided, each of said first followers being in a fixed relationship with one another.

11. The article of adjustable furniture according to claim 10, wherein each of said first guides comprises a slot or groove in which each of said first followers is located.

12. The article of adjustable furniture according to claim 9, wherein at least one of said first or second follower comprises rollers.

13. The article of adjustable furniture according to claim 9, wherein at least one of said first or second guide comprises a slot or groove in a respective one of said side panel and at least one said first follower is provided on said second component.

14. The article of adjustable furniture according to claim 9, wherein said article of furniture is a chair, wherein said second and third components comprise one or more of a base of said article of furniture, a seat pad of said article of furniture, a seat back of said article of furniture, a foot rest of said article of furniture or other supporting part of said article of furniture.

15. An article of adjustable furniture, said article comprising:

a first furniture component, a second furniture component movable relative to said first component and supported by a first telescopic guide arrangement comprising a first guide associated with one of said first component and said second component, and at least one first follower associated with the other one of said first component or said second component, said at least one first follower being movable along said first guide, and a third furniture component movable relative to said first component and supported by a second guide arrangement comprising a second guide associated with one of said first component and said third component, and at least one second follower associated with the other one of said first component or said third component, said at least one second follower being movable along said second guide;

wherein said second guide is of arcuate form and is operative to guide said third component for relative pivoting like movement about a pivot axis located at a centre of curvature of said second guide;

wherein said pivot axis is located a distance away from and not contained within said first, second, or third components of said article of furniture, wherein said first component comprises a load bearing structural support frame including a pair of load bearing side panels, one said load bearing side panel on each side of said article of furniture, with each said side panel supporting one of said first guide or said at least one first follower, and actuator means disposed between said side panels, in an interior region of said article of furniture, for relative movement of said second and third components; and wherein said second and third components comprise one or more of a base, adjustable backrest or other part thereof that are relatively movable and which are adapted to bear at least part of a weight of a user of said article of furniture.

16. The article of adjustable furniture according to claim 15, wherein at least two first guides and at least two first followers are provided, each of said first followers being in a fixed relationship with one another.

17. The article of adjustable furniture according to claim 16, wherein each of said first guides comprises a slot or groove in which each of said first followers is located.

18. The article of adjustable furniture according to claim 15, wherein at least one of said first or second follower comprises rollers.

19. The article of adjustable furniture according to claim 15, wherein at least one of said first or second guide comprises a slot or groove in a respective one of said side panel and at least one said first follower is provided on said second component.

20. The article of adjustable furniture according to claim 15, wherein said article of furniture is a chair, wherein said second and third components comprise one or more of a base of said article of furniture, a seat pad of said article of furniture, a seat back of said article of furniture, a foot rest of said article of furniture or other supporting part of said article of furniture.

* * * * *